US009260964B2

(12) United States Patent
Jones et al.

(10) Patent No.: US 9,260,964 B2
(45) Date of Patent: Feb. 16, 2016

(54) METHOD AND APPARATUS FOR AUXILARY SEAFLOOR MINING

(75) Inventors: Glen Robert Jones, Milton (AU); Antony Eliot Inglis, Milton (AU); Anthony Paul O'Sullivan, Milton (AU); Michael Howitt, Milton (AU); Glen Smith, Milton (AU); Roland Gunter Berndt, Milton (AU); Daal Hallam Jaffers, Milton (AU); Nicholas William Ridley, Wallsend (GB)

(73) Assignee: Nautilus Minerals Pacific Pty Ltd, Milton (AU)

( * ) Notice: Subject to any disclaimer, the term of this patent is extended or adjusted under 35 U.S.C. 154(b) by 114 days.

(21) Appl. No.: 13/805,223

(22) PCT Filed: Jun. 17, 2011

(86) PCT No.: PCT/AU2011/000731

§ 371 (c)(1),
(2), (4) Date: Jun. 6, 2013

(87) PCT Pub. No.: WO2011/156865

PCT Pub. Date: Dec. 22, 2011

(65) Prior Publication Data

US 2013/0241263 A1 Sep. 19, 2013

(30) Foreign Application Priority Data

Jun. 18, 2010 (AU) ..... 2010902669

(51) Int. Cl.

| | |
|---|---|
| ***E21C 25/00*** | (2006.01) |
| ***E02F 3/18*** | (2006.01) |
| ***E02F 3/88*** | (2006.01) |
| ***E02F 3/92*** | (2006.01) |
| ***E02F 5/00*** | (2006.01) |
| ***E02F 7/00*** | (2006.01) |
| ***E21C 50/00*** | (2006.01) |

(52) U.S. Cl.

CPC . *E21C 25/00* (2013.01); *E02F 3/18* (2013.01); *E02F 3/8866* (2013.01); *E02F 3/9268* (2013.01); *E02F 5/006* (2013.01); *E02F 7/005* (2013.01); *E21C 50/00* (2013.01)

(58) Field of Classification Search

CPC ..... E02F 3/18; E02F 3/8866; E02F 3/9268; E02F 5/006; E02F 7/005; E02F 3/88; E02F 3/8858; E21C 25/00; E21C 50/00

USPC ..... 299/7, 8, 9, 73; 405/158, 159, 161, 163, 405/166, 174, 179, 191; 37/307, 314, 326, 37/327, 337, 338, 342, 343, 366, 367

See application file for complete search history.

(56) References Cited

U.S. PATENT DOCUMENTS

| | | | | |
|---|---|---|---|---|
| 3,456,371 | A | 7/1969 | Graham et al. | |
| 3,670,514 | A * | 6/1972 | Breston et al. | 405/160 |
| 6,003,952 | A * | 12/1999 | Smart et al. | 299/9 |

FOREIGN PATENT DOCUMENTS

| | | | |
|---|---|---|---|
| FR | 1553816 | A | 10/1967 |
| FR | 2612987 | A1 | 3/1987 |

(Continued)

OTHER PUBLICATIONS

International Search Report for PCT/AU2011/000731.

*Primary Examiner* — John Kreck
*Assistant Examiner* — Carib Oquendo
(74) *Attorney, Agent, or Firm* — McDonnell Boehnen Hulbert & Berghoff LLP

(57) ABSTRACT

A seafloor auxiliary mining tool for use in a seafloor mining system. The seafloor auxiliary mining tool has a seafloor locomotion system enabling traversal of the seafloor. Umbilical connections receive power and control signals from a surface source. A boom mounted auxiliary cutting tool is configured to cut extremities of a seafloor deposit. Cuttings produced by the auxiliary cutting tool are sized by sizing means, to ensure such cuttings are no greater than a desired size.

24 Claims, 11 Drawing Sheets

(56) References Cited

FOREIGN PATENT DOCUMENTS

| | | | | | |
|---|---|---|---|---|---|
| GB | 2462801 | * | 8/2010 | ..... | E02F 3/88 |
| JP | 58-184398 | U | 12/1983 | | |
| JP | 59-041597 | A | 3/1984 | | |
| JP | 09302713 | A | 11/1997 | | |
| WO | 98/42922 | A1 | 10/1998 | | |

* cited by examiner

METHOD AND APPARATUS FOR AUXILARY SEAFLOOR MINING

The present application is a U.S. National Phase Application pursuant to 35 U.S.C. §371 of International Application No. PCT/AU2011/000731 filed on Jun. 17, 2011, which claims priority to Australian Patent Application 2010902669, filed Jun. 18, 2010, the disclosures of which are incorporated herein by reference in their entirety.

TECHNICAL FIELD The present invention relates generally to underwater mining, and in particular relates to a tool for carrying out seafloor mining in cooperation with other seafloor tools.

BACKGROUND OF THE INVENTION

Seabed excavation is often performed by dredging, for example to retrieve valuable alluvial placer deposits or to keep waterways navigable. Suction dredging involves positioning a gathering end of a pipe or tube close to the seabed material to be excavated, and using a surface pump to generate a negative differential pressure to suck water and nearby mobile seafloor sediment up the pipe. Cutter suction dredging further provides a cutter head at or near the suction inlet to release compacted soils, gravels or even hard rock, to be sucked up the tube, Large cutter suction dredges can apply tens of thousands of kilowatts of cutting power. Other seabed dredging techniques include auger suction, jet lift, air lift and bucket dredging.

Most dredging equipment typically operates only to depths of tens of metres, with even very large dredges having maximum dredging depths of little more than one hundred metres. Dredging is thus usually limited to relatively shallow water.

Subsea boreholes such as oil wells can operate in deeper water of up to several thousand metres depth. However, subsea borehole mining technology does not enable seafloor mining.

Any discussion of documents, acts, materials, devices, articles or the like which has been included in the present specification is solely for the purpose of providing a context for the present invention. It is not to be taken as an admission that any or all of these matters form part of the prior an base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY OF THE INVENTION

According to a first broad aspect the present invention provides a seafloor auxiliary mining tool for use in a seafloor mining system, the seafloor auxiliary mining tool comprising:

- a seafloor locomotion system enabling traversal of the seafloor;
- umbilical connections for receiving power and control signals from a surface source;
- a boom mounted auxiliary cutting tool for cutting extremities of a seafloor deposit; and

- means for sizing cuttings produced by the auxiliary cutting tool to ensure such cuttings are no greater than a desired size.

According to a second aspect the present invention provides a method for seafloor auxiliary mining in a seafloor mining system, the method comprising:

- a seafloor auxiliary mining tool traversing the seafloor using a seafloor locomotion system;
- the tool receiving power and control signals from a surface source via umbilical connections;
- a boom mounted auxiliary cutting tool cutting extremities of a seafloor deposit; and
- a sizing means of the tool sizing cuttings produced by the auxiliary cutting tool to ensure such cuttings are no greater than a desired size.

The means for sizing cuttings may comprise at least one pair of cutting heads which form the auxiliary cutting tool, the cutting heads being configured to preferentially draw cuttings between the pair of cutting heads, and the pair of cutting heads being spaced apart by a distance corresponding to the desired cutting size. In such embodiments, cuttings larger than the desired cutting size which are drawn between the pair of cutting heads will be further cut and/or crushed to be less than the desired cutting size. The spacing between the or each pair of cutting heads can be fixed at a predetermined spacing, for example depending on the ore being mined and the size of particles needing to be extracted. Alternatively, the spacing between the or each pair of cutting heads may in some embodiments be adjustable during mining operations. Alternatively, the means for sizing cuttings may comprise a sizing grill proximal to the auxiliary cutting tool, for example positioned above the cutting head between the head and the boom, and/or aft of the cutting head. Alternatively, the means for sizing cuttings may comprise other suitable sizing devices whether fixed or adjustable. The pair of cutting heads are preferably counter-rotating so as to draw cuttings between the cutting heads to effect sizing of the cuttings.

By providing the auxiliary mining tool with an auxiliary cutting tool, and leaving bulk mining for a separate seafloor tool, the present invention provides for a relatively agile seafloor cutting tool which has enhanced mobility enabling operation in seafloor regions of complex topography and which can flexibly perform an array of cutting tasks. The auxiliary cutting tool can thus be used in preparation for bulk mining to cut down peripheries of complex seafloor formations in order to present relatively flat and horizontal benches suitable for a separate bulk mining tool. The present invention thus provides an auxiliary tool operable to function in cooperation with other seafloor mining tools to effect retrieval of the seafloor material, even when presented with a complex seafloor topography, while able to function alone when presented with complex seafloor topography. At some sites the agility of the auxiliary mining tool may be such that other tools may not be required to effect retrieval of the seafloor material.

The seafloor auxiliary mining tool is capable of traversing uneven ground and slopes, such capability being affected by the seafloor locomotion system. The seafloor locomotion system may comprise any suitable locomotion elements, for example wheels, continuous tracks, legs, or the like. The locomotion system preferably enables the auxiliary mining tool to traverse seafloor terrain sloped up to about 10 degrees, more preferably up to about 20 degrees and even more preferably up to about 25 degrees.

The auxiliary mining tool in preferred embodiments is operable to work a seafloor site to prepare a bench for bulk mining. The auxiliary mining tool in preferred embodiments is further operable to work remnant edges left by a bulk miner. The boom for mounting the auxiliary cutting tool preferably comprises an hydraulically operated articulated arm. In one form, the boom may be mounted on an upper carriage assembly capable of slewing relative to the auxiliary mining tool centre line.

In some embodiments of the invention, the seafloor auxiliary mining tool may comprise a detachable winch cable attachment point, allowing the tool to be winched between the seafloor and the surface, and to detach from the winch cable and self-propel once on the seabed.

Further, the present invention provides a seafloor auxiliary mining tool adaptable in some embodiments to deployment at significant water depths. For example some embodiments may be operable at depths greater than about 400 m, more preferably greater than 1000 m and more preferably greater than 1500 m depth. Nevertheless it is to be appreciated that the auxiliary mining tool of the present invention may also present a useful seafloor mining option in water as shallow as about 100 m or other relatively shallow submerged applications. Accordingly it is to be appreciated that references to the seafloor or seabed are not intended to exclude application of the present invention to mining or excavation of lake floors, estuary floors, fjord floors, sound floors, bay floors, harbour floors or the like, whether in salt, brackish, or fresh water, and such applications are included within the scope of the present specification.

In embodiments of he invention deployed to seafloor sites of complex topography, the seafloor auxiliary mining tool is preferably employed to initiate site excavation. For example the seafloor auxiliary mining tool may prepare a landing area for other seafloor tools, and may excavate extremities of the site in order to prepare a first bench ready for bulk mining.

A preferred embodiment of the invention further includes a suction delivery line having an inlet adjacent to the auxiliary cutting tool and an outlet spaced from the auxiliary mining tool. In preferred embodiments of the invention, the auxiliary mining tool comprises a slurry pump system and a slurry inlet proximal to the cutting head(s), configured to capture cuttings in the form of a slurry. The slurry may be pumped a short distance from the seafloor auxiliary mining tool, for example simply to one side of the path taken or to be taken by the tool. Alternatively, the slurry may be pumped to a seafloor stockpile location some distance away from the seafloor auxiliary mining tool via a suitable transfer pipe. The slurry inlet, or suction inlet, may be positioned just all of the cutting head. In embodiments comprising two or more cutting heads, the or each suction inlet may be positioned between cutting heads.

In preferred embodiments, a collection shroud partially surrounds the cutting head(s) to optimise containment and collection of cuttings by the slurry pump system. The seafloor auxiliary mining tool preferably comprises a blade to help keep cuttings ahead of the vehicle, and also preferably configured to shroud the cutting tool by maintaining cuttings near the cutting head and assist reworking of oversized cuttings. The blade is preferably arcuately shaped so as to effect substantially equal shrouding at differing slew positions of the cutting tool. The blade preferably assists a suction inlet of the tool in clearing cuttings produced by the cutting heads. The blade is also preferably configured to clear the path ahead of the auxiliary mining tool by acting as a push blade as the machine traverses forwards.

The seafloor auxiliary mining tool may be an untethered remotely operated vehicle (ROV) or may be a tethered vehicle operated by umbilicals connecting to the surface.

The seafloor auxiliary mining tool preferably clears its own cuttings to the spaced outlet at a dump site to enable the seafloor auxiliary mining tool to progress through a formation as it works. For example the auxiliary mining tool may pump its cuttings in slurry form to a position lateral to the tool's path of travel.

The seafloor auxiliary mining tool's weight is preferably selected in order to apply the forces required for the auxiliary mining tasks. In order to further stabilise the auxiliary mining tool, movable anchoring spuds may be provided.

The bench may comprise an ore bench of valuable ore to be retrieved, or may comprise a bench of hard rock, or other seafloor material to be removed for other purposes. The ore may comprise seafloor massive sulphides.

In an alternative embodiment of the system, the auxiliary miner is configured with slurry transfer pipes which are arranged to deliver cuttings from the tool in a slurry form to a stockpile site distal from the cutting location of the tool.

BRIEF DESCRIPTION OF THE DRAWINGS

An example of the invention will now be described with reference to the accompanying drawings, in which.

DESCRIPTION OF THE PREFERRED EMBODIMENTS

Figure 1:
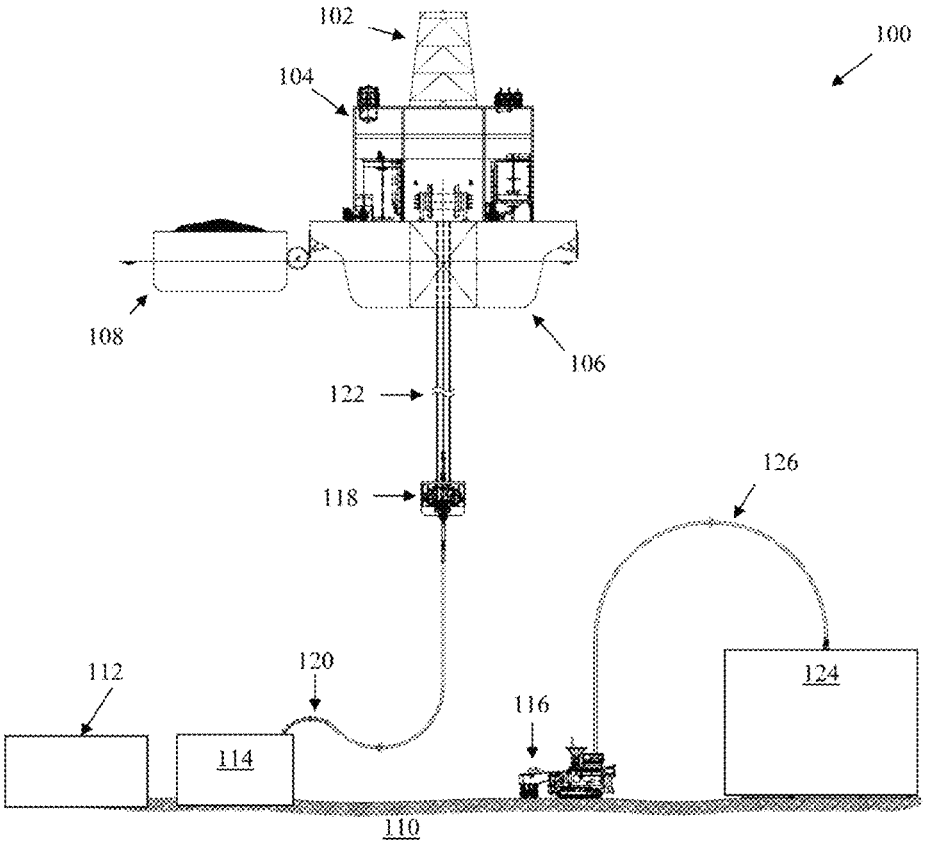
FIG. 1 is a simplified overview of a subsea system incorporating an auxiliary mining tool in accordance with a preferred embodiment of the present invention.

FIG. 1 is a simplified overview of a subsea system 100, which incorporates an auxiliary mining tool (AUX) 116 in accordance with an embodiment of the present invention. A derrick 102 and dewatering plant 104 are mounted upon an oceangoing production support vessel (PSV) 106. The PSV 106 has ore transfer facilities to load retrieved ore onto barge 108. The present embodiment provides a tool 116 operable to about 2500 m depth, however alternative embodiments may be designed for operation to about 3000 m depth or greater. During production operations, seafloor mining took (SMTs) will be used to excavate ore from the seabed 110. The SMTs comprise a seafloor bulk miner 112, a seafloor gathering machine (GM) 114 and a seafloor auxiliary mining machine 116 and a stockpiling system 124. The bulk miner (BM) 112 and gatherer 114 may be of any suitable form. In this embodiment ore mined by the auxiliary mining machine 116 and hulk mining machine 112 is gathered and pumped by each respective machine in the form of a slurry to a stockpile system 124, for example through stockpile transfer pipe 126 (shown interrupted in FIG. 1 for clarity).

The stockpiled ore is gathered and pumped, in the form of slurry, through a riser transfer pipe (RTP) 120 to a subsea lift pump 118, which then lifts the slurry via a rigid riser 122 (shown interrupted in FIG. 1, and may he up to about 2500 m long in this embodiment). The slurry travels to the surface support vessel 106 where it is dewatered by plant 104. The waste water is returned under pressure back to the seafloor to provide charge pressure for the subsea lift pump 118. The dewatered ore is offloaded onto transport barge 108 to be transported to a stockpile facility before being transported to a processing site.

The seafloor auxiliary mining tool 116 of this embodiment is provided for cutting and if/as required pumping material away from a work face location. The seafloor auxiliary mining tool 116 is a remote operated vehicle, capable of operating to a water depth of about 2500 m, and is operated from on board the PSV 106. Operation of the seafloor auxiliary mining tool 116 is controlled subject to ore grade, over-all production rate and operational and maintenance constraints. Excavated particle size is controlled by the auxiliary mining tool 116 cutter type, cutter rotation speed, speed of advancement of the cutter heads, depth of cut, cutter pick spacing and angle and cutter head spacing.

Bulk mining and gathering can then be carried out by any suitable means.

Figure 7A:
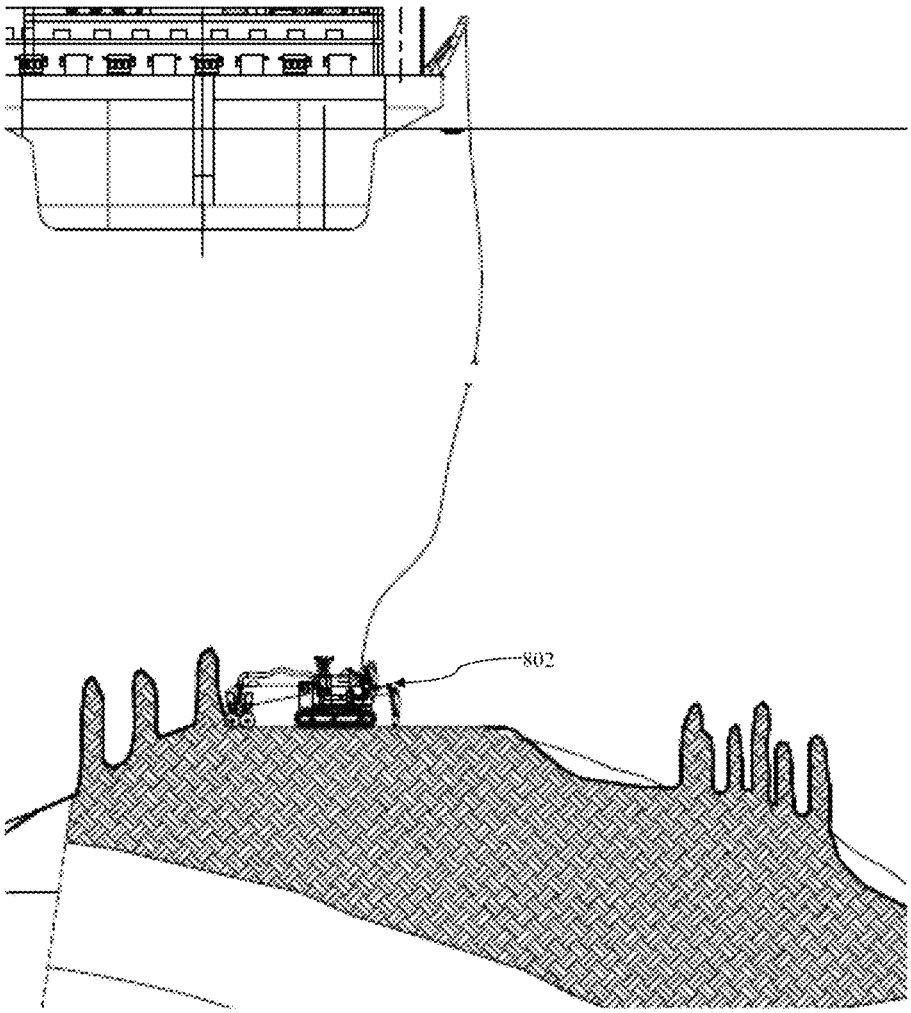
FIG. 7*a* depicts the auxiliary mining tool performing site preparation.

While the auxiliary mining tool 116 may be utilised in any suitable mining process, in the embodiment shown in FIG. 1 the ore recovery sequence is as follows. First, any unconsolidated sediment is removed using the gathering machine (GM), and deposited in a pre defined area that may or may not form part of the mine. Then, obstructions are cut down using the AUX 116 of this embodiment, to prepare a level landing area for the BM 112 and GM 114, This site preparation by the auxiliary mining machine 116 is illustrated in FIG. 7*a*.

Figure 7B:
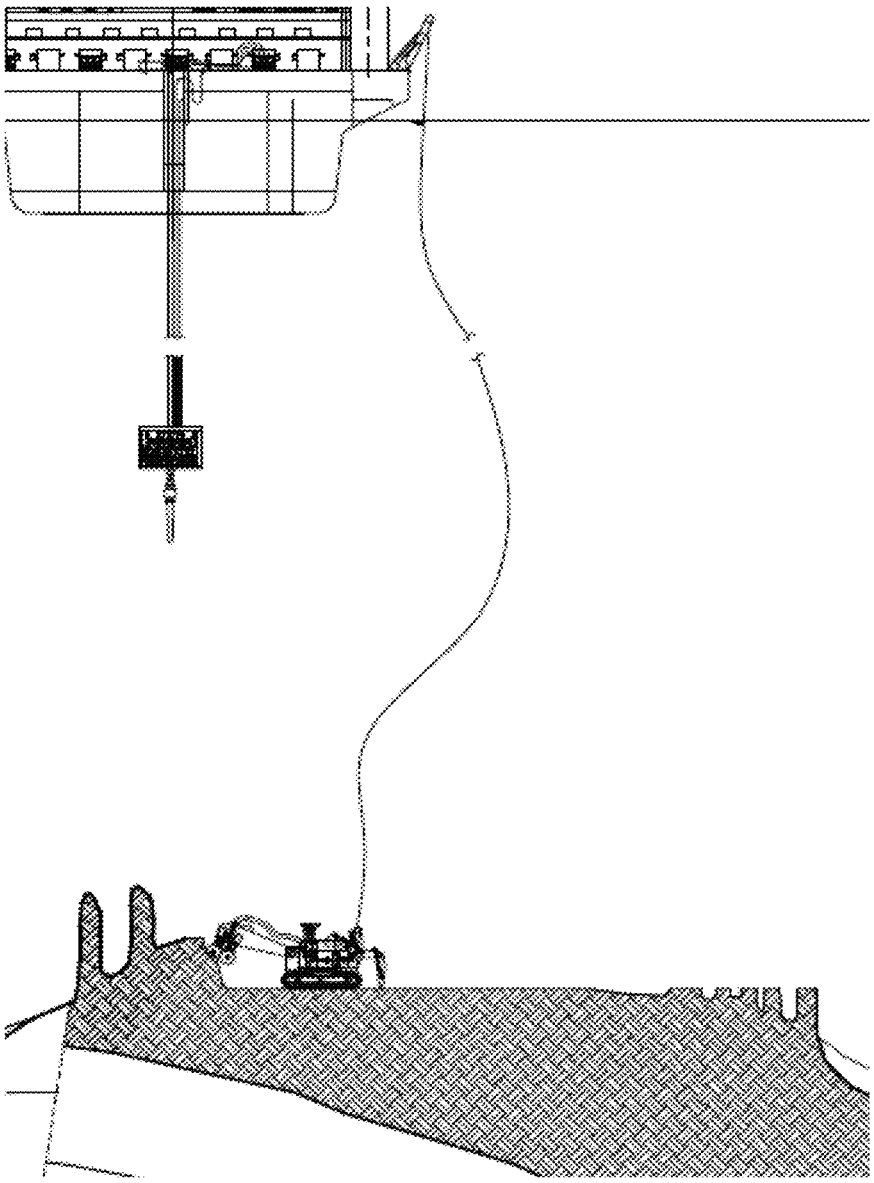
FIG. 7*b* depicts the auxiliary mining tool trimming remnant edges of an ore bench.

Next, ore left by the auxiliary mining tool 116 is gathered with the GM 114. Benches are cut using the BM 112 then cut and sized ore is gathered using GM 114, this being repeated until remnant edges are about 4 metres high. Then, the remnant edges are trimmed using the AUX 116 of this embodiment, as shown in FIG. 7*b*.

Thus, the AUX 116 initiates seafloor mining operations and prepares an adequate landing area for other seafloor tools, and if required for other seafloor devices such as a stockpiling device. The AUX 116 is also used to remove edge sections of ore benches which cannot be accessed or efficiently mined by a bulk miner.

Figure 2:
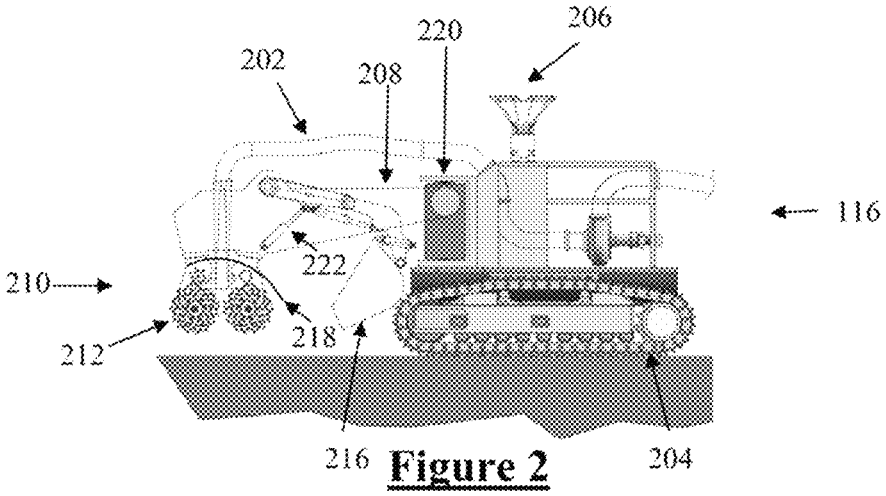
FIG. 2 is a side view of an auxiliary mining tool in accordance with one embodiment of the present invention.

FIG. 2 is a side view of auxiliary mining tool 116 in accordance with this embodiment of the present invention. FIG. 2 illustrates the size of the AUX 116 of this embodiment, giving insight into its functionality. The AUX 116 pumps ore utilising a slurry dredge pump system 202, to a seafloor stock pile area., which is then gathered at a later date by suitable seafloor gathering machine (GM) 114. Continuous tracks 204 provide for seafloor locomotion of the tool 116, even over complex seafloor topography. Winch cable attachment point 206 permits detachable attachment of the tool 116 to a winch cable to permit winching of the tool 116 between the surface and the seafloor. Cutting head 210 is mounted on boom 208, permitting use of cutting head 210 in a versatile range of positions, heights, and angles.

Figure 3:
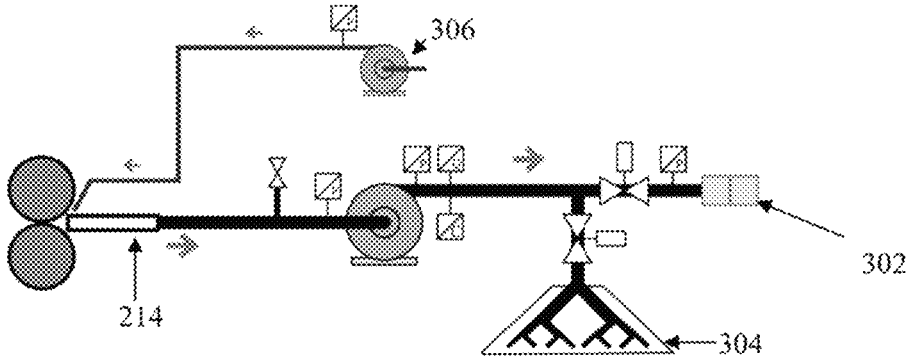
FIG. 3 illustrates the cutting and suction process of the auxiliary mining tool of FIG. 2.
Figure 5:
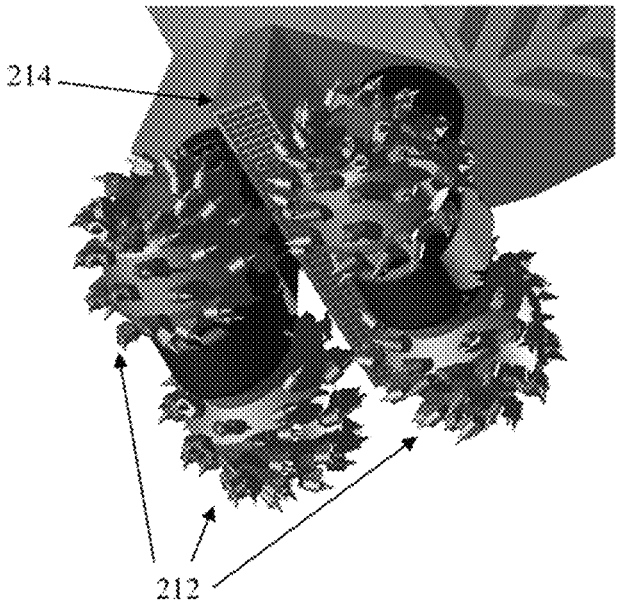
FIG. 5 is a perspective view of the boom-mounted cutting head of the auxiliary mining tool.

FIG. 3 illustrates the cutting and suction process of the auxiliary mining tool 116. As can be seen, the AUX 116 is a vehicle with tracks 204 and a cutter suction boom assembly 208, which is articulated and capable of boom stewing of about +/−40 degrees laterally of the machine centre tine and is capable of rising above and below the machine. As seen in FIG. 5, cutting head 210 comprises two pairs of counter rotating cutter heads 212 which are electrically or hydraulically driven via umbilical power supply to cut ore and deliver cuttings to an inlet in the form of a centrally located suction head 214 located in between the counter-rotating cutter heads 212. Suction head 214 can be in various shapes and sizes to suit the size and type of material being cut and extracted. Shown in FIG. 2, a bucket/blade 216 is also provided to assist with material clearing and add to the effectiveness of the cutters 212. Bucket/blade 216 also acts as a shroud for the cutters to aid in the suction removal of the cuttings. A shroud 218 in FIG. 2 is also provided to assist in the effectiveness of the suction head 214 in FIG. 5 and size the cuttings and control the size of the cuttings.

Tool 116 may further comprise a water jet system (not shown) for high pressure water injection to the cutter head 210, and a slurry / ore suction / delivery line, using a suction dredge pump system, to pump cut material and transport it to a subsea stock pile zone via a stockpile hose 126 of FIG. 1 and connector system, and stockpile system 124. In another embodiment, an upper carriage assembly 220 in FIG. 2 provides the capability of slewing the auxiliary mining vehicle's cutting heads. In another embodiment a further assembly (hydraulic cylinder 222) on the cutter heads allows the spacing of the cutter heads to be adjusted during operation to improve cutting efficiency and cuttings extraction efficiency and size the cuttings and control the size of the cuttings.

In this embodiment the tool 116 has a dry land weight of approx 200 to 250 tonnes, a cutting power to tool weight ratio suitable for this type of machine, and a number of primary functions, The tool 116 removes obstructions and high points and prepares a clear landing area for other tools to commence cutting operations, as shown in FIG. 7*a*. Tool 116 cuts and cleans areas of the bench that are inaccessible to a less agile bulk miner, as shown in FIG. 7*b*. The tool 116 can pump cut material to a seafloor stockpile area, and assist with levelling and grinding up seafloor chimneys. The boom action of the tool 116 enables cutting of bench heights of up to about 4 m, even on a slope, and enables the tool 116 to clear bench edges and/or footwall interfaces which are not readily accessible by less agile seafloor tools.

The auxiliary mining tool 116 is further operable to perform tidying cuts to clean up the mine site at the completion of mining, and can also cut an access ramp for other seafloor tools to high points of a mine, and/or cut a ramp up to a peak area thus generating its own access way to the peak itself.

The tool 116 is manoeuvred on the seafloor by means of crawler tracks 204. It is capable of handling rocky ground and rough terrain, and has an ability to both operate and manoeuvre on slopes. The tool 116 can also be lifted and landed to relocate around the site using its main winch wire 402, from the support vessel.

The AUX 116 is designed to cut and gather ore, pumping it to either a stockpile or to a side cast zone just behind or beside the vehicle. The AUX 116 is designed with a counter rotating cutter head 210 complete with central suction head 214 to cut ore efficiently and if/as required deliver it to a stockpile at a spaced location.

The cutter/suction head 210 is mounted on an articulated boom 208 capable of slewing, lifting and lowering, and changing the angular position of the cutter suction head 210 in the vertical plane. The forward and aft spacing of the cutter heads can be changed by mechanism 222 to adjust and increase cutting and suction efficiency during operations and size the cuttings and control the size of the cuttings.

Figure 4:
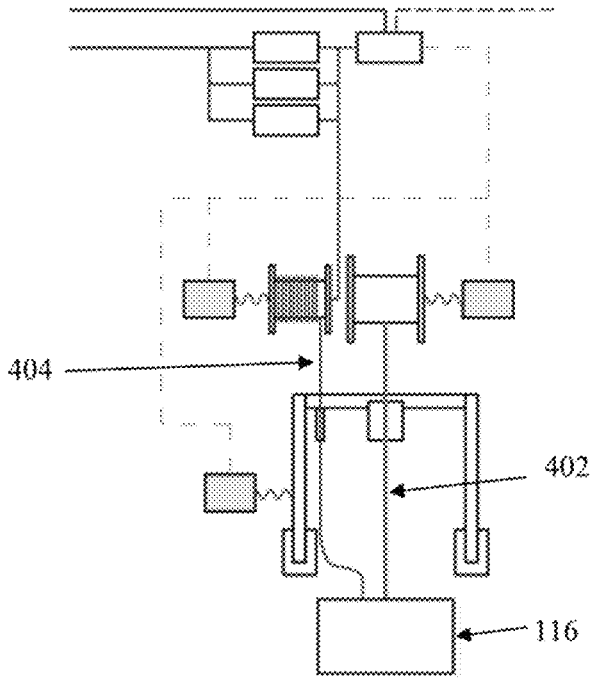
FIG. 4 depicts the overall auxiliary mining tool system.

The overall Auxiliary Mining Machine system is outlined in FIG. 4. The Production Support Vessel (PSV) hosts the control room from which the AUX 116 is operated, along with the winches for both the umbilical and the lift wire, and an A frame for deployment and recovery of the AUX 116. The AUX is connected to the vessel by means of an umbilical cable 404, and a main hoist wire 402.

The umbilical cable 404 provides electrical power to drive the motors and pumps required to drive the main components of the AUX 116, such as track drive motors, hydraulic system drive motor(s), dredge system pump drive motor(s) and the cutter drive system.

The umbilical 404 also provides control lines suitably in the form of multiplexed fibre optic communication links between the AUX 116 and the operational controls on the PSV 106.

The AUX 116 is lowered from the PSV 106 to the seafloor, via the main hoist wire 402. When the AUX 116 is landed out on the seafloor, the hoist wire 402 can be disconnected and recovered either back to the PSV 106, or to a safe height whereby it will not get tangled with the umbilical 404 during mining operations.

The AUX 116 incorporates systems within the chassis to find, engage, secure and disconnect the stockpile hose connector (also incorporating a coupling, emergency disconnect system and swivel). If required, a stockpile hose may be stored within the AUX chassis on a stowage arrangement such as a wind-out reel. Once the AUX 116 is on the seafloor, a stockpile hose is connected (if required for stockpile mining operations) and the AUX 116 is then ready for cutting and stockpiling operations.

When the AUX 116 is ready to be recovered to the PSV 106, the hoist wire 402 is reconnected and the stockpile hose disconnected. The cutter boom 208 is slewed to the zero degree, fully extended and lifted position. Tool 116 can then be lifted from the seafloor, and recovered to the PSV 106.

As previously outlined, the AUX incorporates two different methods for ore placement, those being the vehicle rear or side-cast method, and the stockpile transfer method. As shown in FIG. 3, control of suitable valves allows slurry from suction head 214 to be selectively directed to either a stockpile hose connector system 302, or a rear/side cast lay down outlet 304. The rear or sidecast method is utilised in areas that are easily, and efficiently accessed by the gathering machine 114 (for subsequent clean up and recovery of the material). The stockpile method is utilised for restricted access areas so as to transfer the ore to a pre-defined stockpile location from which the GM 114 will recover the ore. Appropriate mine planning can define which ore placement method will be adopted for which location.

Figure 6:
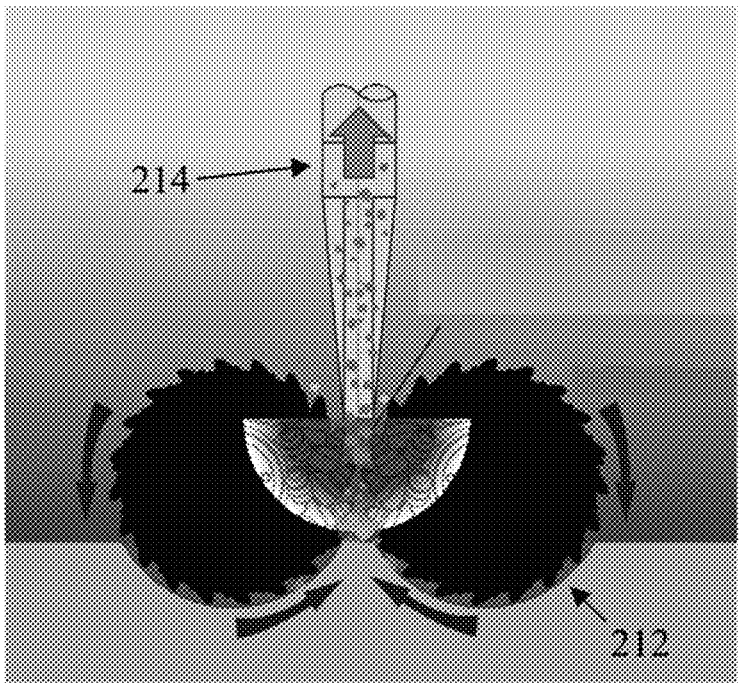
FIG. 6 is a cross sectional view of the boom-mounted cutting head of the auxiliary mining tool in operation.

A dual counter-rotating drum cutter 210 is used for the main cutting head which is outlined in general in FIGS. 5 and 6. The cutter 210 is mounted on a two function hydraulic boom 208 which is capable of lifting and lowering in the horizontal axis, and slewing around the vertical axis. The boom 208 provides a versatile mounting for the cutter assembly 210 and allows a large volume of rock to be cut without moving the vehicle itself. This versatility allows the arm 208 and cutter 210 to 'target', for example, steps or other discontinuities, such as isolated towers, as may be encountered in the mine. The rock cutter head 210 is of about 600 kW power, on an articulated arm 208, which provides a versatile mounting for the cutter and allows large volumes of rock to be cut without moving the auxiliary miner itself.

The boom 208 operates in successive downward/sideward cuts to complete a full sump depth, full width cut of the mine face to an approximate sumping depth around 1 metre. The boom and cutter angle positions can then be adjusted to carry out a further 1 metre sumping depth cut before the vehicle is required to reposition forward.

The excavated material can be drawn away from the work area, through the suction nozzle 214 detailed in FIGS. 5 and 6, by a high flow dredge pump system. The slurry flow circuit is shown in more detail in FIG. 3. A dilution system is used to reduce the chances of blockage and control the slurry density in the suction and delivery lines. A densitometer and flow meter is used to constantly monitor the concentration and velocity gradients through the slurry circuit.

Figure 8:
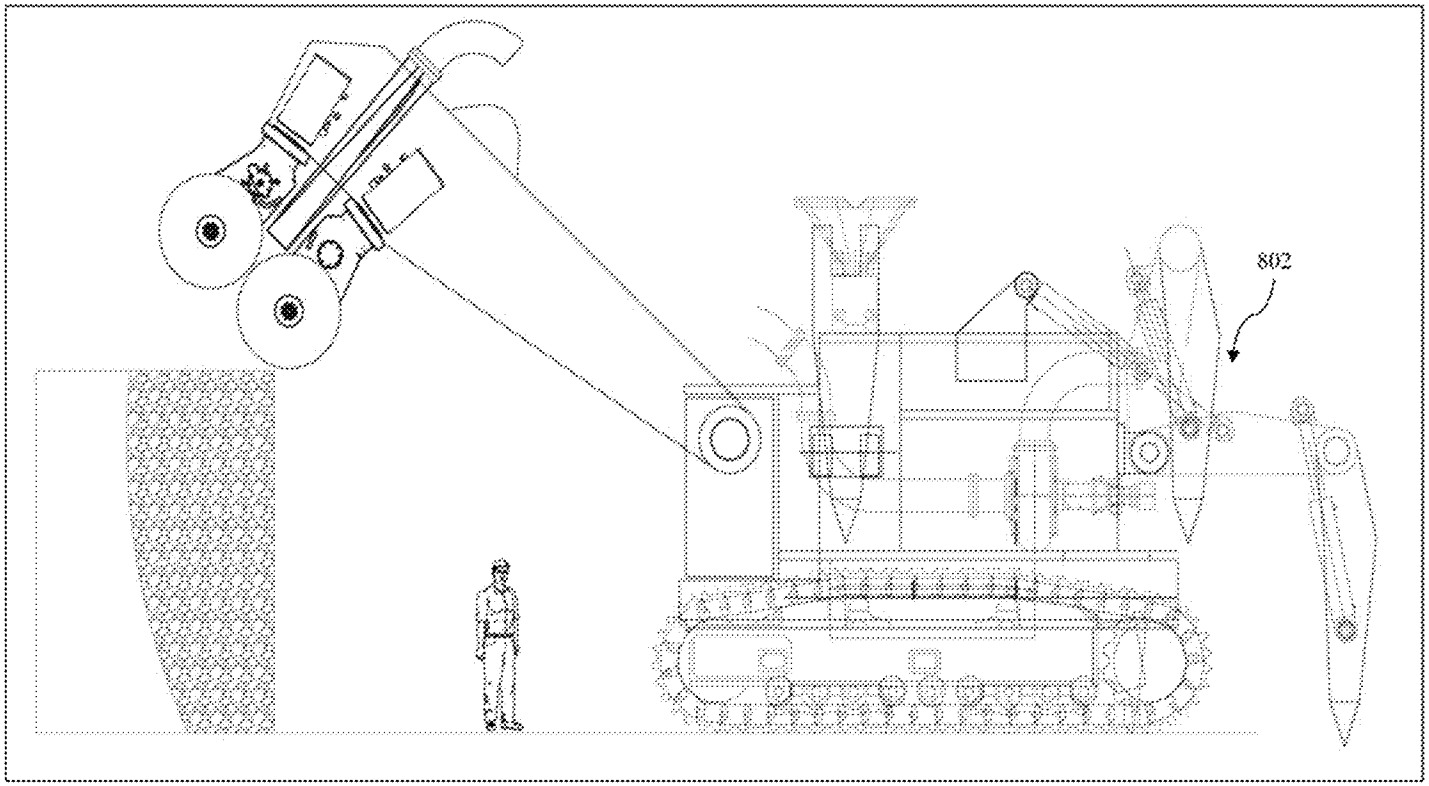
FIG. 8 depicts a further embodiment of the auxiliary mining tool with a moveable anchoring/stabilising spud system.
Figure 9A:
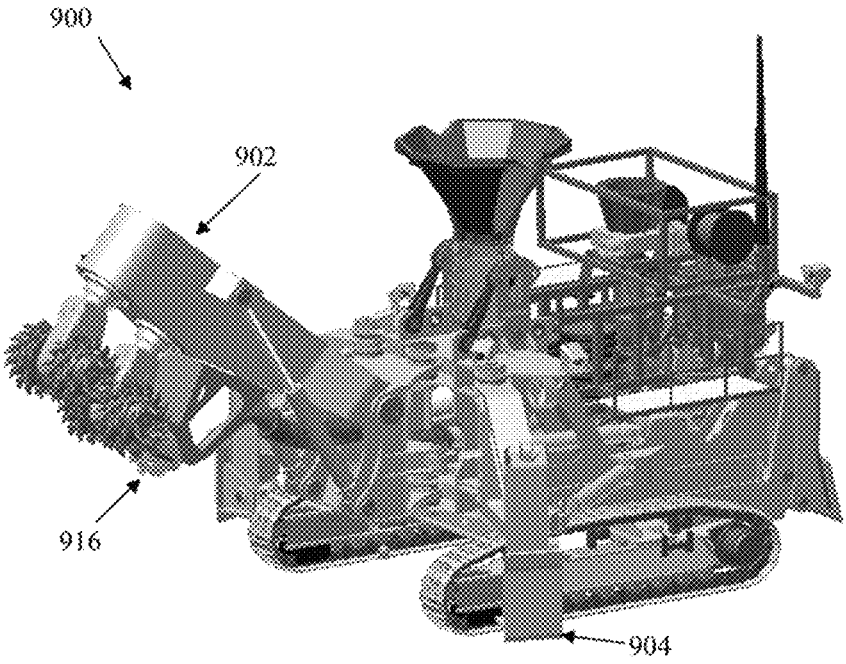
FIGS. 9*a*-9*d* illustrate an auxiliary cutter in accordance with another embodiment of the invention.
Figure 9B:
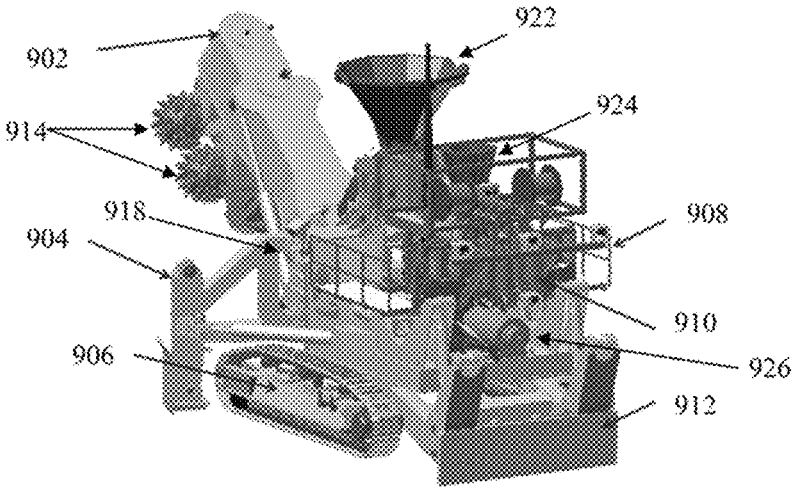
Figure 9C:
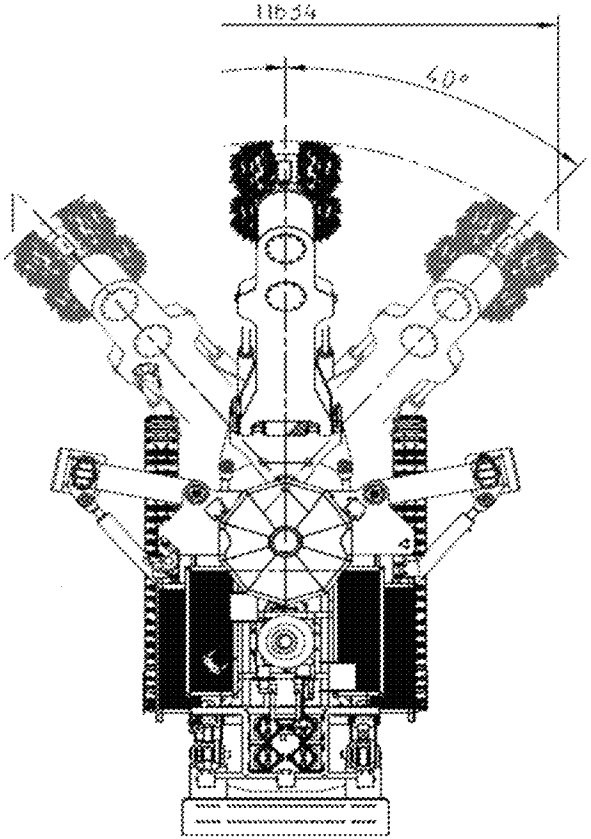
Figure 9D:
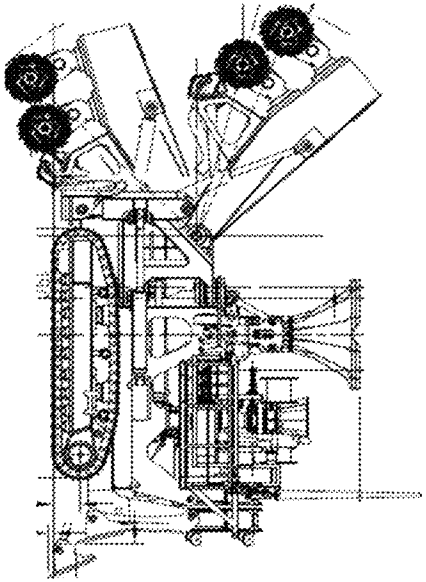

The AUX 114 of the further embodiment is a tracked vehicle. Whilst mining, a moveable anchoring system taking the form of stabilising spuds engage and penetrate the seafloor surface layer in order to provide more positive control of the miner, as shown in FIGS. 7*a* and 7*b*. As further shown in FIG. 8, each movable spud 802 of a vehicle anchoring/stabilising system is independently powered, allowing limited ability to level the vehicle on uneven ground. The spuds are designed to penetrate through any loose surface material to locate into good quality ground. For soft ground, larger area shoes can be fitted to the spuds. The spuds can also each be in the form of a blade. The blade then allows the functionality of a spud and also allows an ability to move material during forward or aft locomotion of the machine.

A jet water system 306 is installed to provide clearance of the suction grizzly 214 in the event of blockage, and agitation of the material face to be cut if required. The jet system 306 can clean the cutter head 210 or tracks 204 in the event of clogging. The jet system may also assist with slurry line blockage prevention/clearance.

The AUX 116 can move from one area of the seafloor to another in one of two ways. The AUX 116 is capable of tracking on seafloor topographies of less than about 10 degrees, at rates >about 600 m/hour. Alternatively, the vehicle 116 can be hoisted off the seafloor using the main hoist wire 402, and manoeuvred to the next site.

When manoeuvring in the locality, the powerful track assemblies 204 provide for efficient repositioning of the vehicle 116 for maximum operational production capability. The AUX 116 thus provides more efficient cutting and stockpiling of excavated material.

FIGS. 9*a*-9*d* illustrate an auxiliary cutter 900 in accordance with another embodiment of the invention, comprising a cutting tool support boom 902, front swing-out stabilising legs 904 with vertical jacking, tracks 906 for site traversing, a rear sonar array 908, electronic control pod indicated at 910, a rear stabilising anchor/blade 912, main cutting tools 914, a crown cutter stockpile gathering system 916 mounted to the underside of boom 902, two thrusters 918, a lifting point and capture bowl 922 for 20 degree slope recovery, a stockpile hose interface 924 and a slurry transfer pump and motor 926.

Figure 10A:
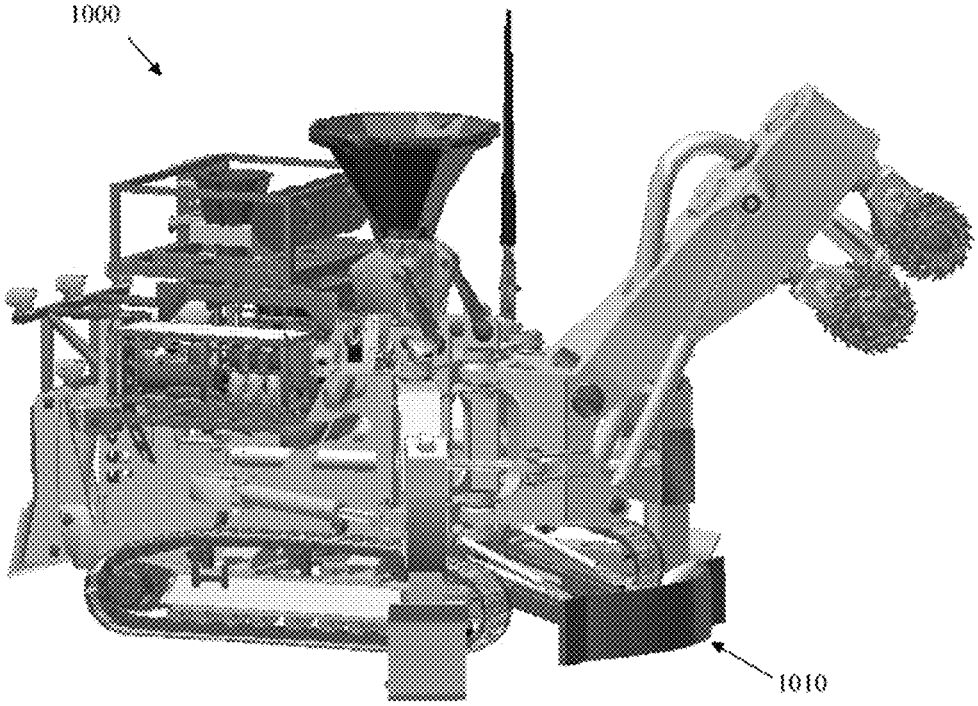
FIGS. 10*a* and 10*b* illustrate an auxiliary cutter in accordance with a further embodiment of the invention.
Figure 10B:
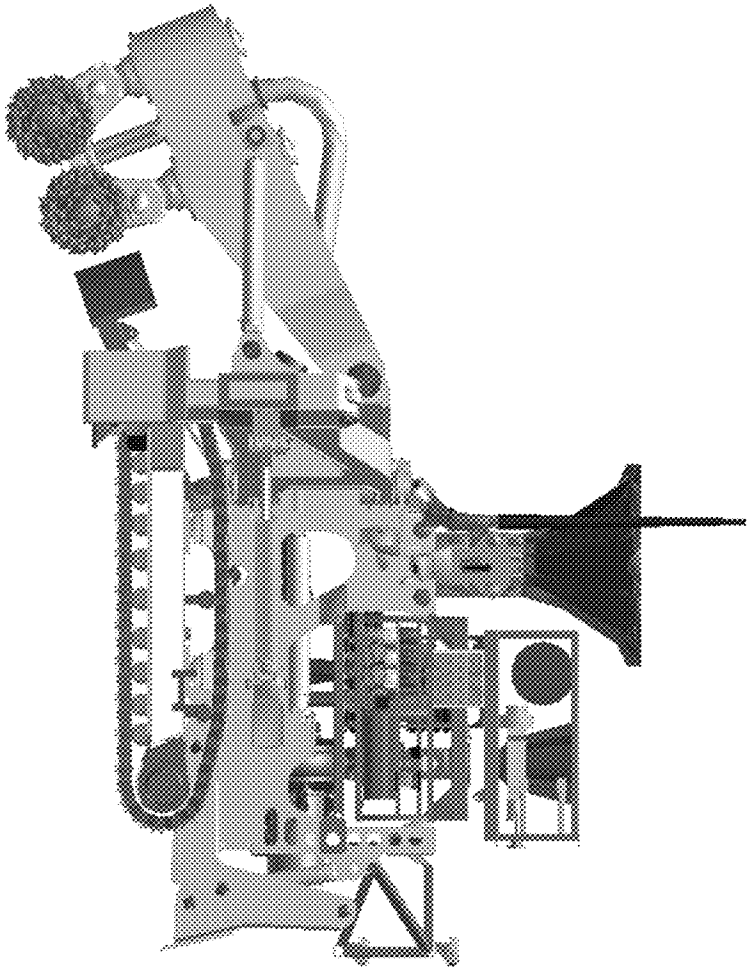

FIG. 10 illustrates a further embodiment of the invention in which an auxiliary miner 1000 has a blade 1010 to push cuttings ahead of the chassis and minimise or avoid cuttings passing beneath the tool 1000. Blade 1010 is semicircularly curved so that the aft cutting heads remain at a substantially constant distance from the blade when moved azimuthally, as shown in FIG. 10*b*. This arrangement effects improved efficiency of gathering by the suction inlet adjacent the cutting head, as visible in FIG. 10*b*, and also clears stray cuttings from the path of the tool.

It is to be appreciated that particular terms used herein may he synonymous with other terms which equally describe the present invention and the scope of the present application is thus not to he limited to any one such synonym. For example, seafloor mining tools may also be referred to as subsea machines, a production support vessel may be referred to as a surface vessel and/or surface facilities, ore may be equally or alternatively referred to as rock, consolidated sediment, unconsolidated sediment, soil, seafloor material, and mining may comprise cutting, dredging or otherwise removing material. Moreover, particular values provided give an illustration of scale in the described embodiments but are not to be considered restrictive as to the scale or range of values which might be used in other embodiments to suit the environment of application.

It will be appreciated by persons skilled in the art that numerous variations and/or modifications may be made to the invention as shown in the specific embodiments without departing from the spirit or scope of the invention as broadly described, The present embodiments are, therefore, to be considered in all respects as illustrative and not restrictive.

The invention claimed is:

1. A seafloor auxiliary mining tool for use in a seafloor mining system, the seafloor auxiliary mining tool comprising:

a seafloor locomotion system enabling traversal of the seafloor;

umbilical connections for receiving power and control signals from a surface source;

a boom mounted auxiliary cutting tool for cutting extremities of a seafloor deposit; and means for sizing cuttings produced by the auxiliary cutting tool to ensure such cuttings are no greater than a desired size, wherein the means for sizing cuttings comprises at least one pair of cutting heads which form the auxiliary cutting tool, the cutting heads being configured to draw cuttings between the pair of cutting heads, and the pair of cutting heads being spaced apart by a distance corresponding to the desired cutting size.

2. The tool of claim 1 wherein the spacing between the or each pair of cutting heads is fixed at a predetermined spacing.

3. The tool of claim 1 wherein the spacing between the or each pair of cutting heads is adjustable during mining operations.

4. The tool of claim 1 wherein the means for sizing cuttings comprises a sizing grill proximal to the auxiliary cutting tool.

5. The tool of claim 1 wherein the locomotion system enables the auxiliary mining tool to traverse seafloor terrain sloped up to about 10 degrees.

6. The tool of claim 5 wherein the locomotion system enables the auxiliary mining tool to traverse seafloor terrain sloped up to about 20 degrees.

7. The tool of claim 6 wherein the locomotion system enables the auxiliary mining tool to traverse seafloor terrain sloped up to about 25 degrees.

8. The tool of claim 1 wherein the boom for mounting the auxiliary cutting tool comprises an hydraulically operated articulated arm mounted on an upper carriage assembly capable of slewing relative to the auxiliary mining tool centre line.

9. The tool of claim 1 when operable at depths greater than about 400 m.

10. The tool of claim 9 when operable at depths greater than about 1000 m.

11. The tool of claim 10 when operable at depths greater than about 1500 m.

12. The tool of claim 1 further comprising a suction delivery line having a slurry inlet adjacent to the auxiliary cutting tool and configured to capture cuttings in the form of a slurry for delivery to an outlet spaced apart from the auxiliary mining tool.

13. The tool of claim 12 wherein the slurry inlet is positioned proximal to and aft of the cutting head.

14. The tool of claim 12 wherein the slurry inlet is positioned between cutting heads of the cutting tool.

15. The tool of any one of claim 12, further comprising a collection shroud which partially surrounds the cutting tool to optimise containment and collection of cuttings by the slurry inlet.

16. The tool of claim 12, further comprising a blade configured to shroud the cutting tool and clear the path ahead of the auxiliary mining tool by acting as a push blade when the machine traverses forwards.

17. The tool of claim 16 wherein the blade is arcuately shaped so as to effect substantially equal shrouding at differing slew positions of the cutting tool.

18. The tool of claim 1 further comprising movable anchoring spuds configured to stabilise the tool when deployed.

19. A method for seafloor auxiliary mining in a seafloor mining system, the method comprising:

a seafloor auxiliary mining tool traversing the seafloor using a seafloor locomotion system;

the tool receiving power and control signals from a surface source via umbilical connections;

a boom mounted auxiliary cutting tool cutting extremities of a seafloor deposit; and a sizing means of the tool sizing cuttings produced by the auxiliary cutting tool to ensure such cuttings are no greater than a desired size, wherein the means for sizing cuttings comprises at least one pair of cutting heads which form the auxiliary cutting tool, the cutting heads being configured to draw cuttings between the pair of cutting heads, and the pair of cutting heads being spaced apart by a distance corresponding to the desired cutting size.

20. The method of claim 19 wherein the auxiliary cutting tool is used in preparation for bulk mining to cut down peripheries of complex seafloor formations in order to present relatively flat and horizontal benches suitable for a separate bulk mining tool.

21. The method of claim 19 wherein the auxiliary cutting tool is used to work a seafloor site to prepare a bench for bulk mining.

22. The method of claim 19 wherein the auxiliary cutting tool is used to work remnant edges left by a bulk miner.

23. The method of claim 19 wherein cuttings are captured in slurry form and the slurry is pumped to one side of the path taken or to be taken by the tool.

24. The method of claim 19 wherein cuttings are captured in slurry form and the slurry is pumped to a seafloor stockpile location spaced apart from the seafloor auxiliary mining tool via a suitable transfer pipe.

* * * * *